US007628482B2

(12) United States Patent
Izumi

(10) Patent No.: US 7,628,482 B2
(45) Date of Patent: Dec. 8, 2009

(54) PRINTING APPARATUS AND PRINTING MEDIUM ROLL-UP STATE DISCRIMINATION METHOD

(75) Inventor: Yohei Izumi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 398 days.

(21) Appl. No.: 11/760,438

(22) Filed: Jun. 8, 2007

(65) Prior Publication Data

US 2007/0291093 A1 Dec. 20, 2007

(30) Foreign Application Priority Data

Jun. 19, 2006 (JP) ..... 2006-169387

(51) Int. Cl.
*B41J 15/16* (2006.01)

(52) U.S. Cl. ..... 347/104; 347/218

(58) Field of Classification Search ..... 347/101, 347/104, 218; 400/613
See application file for complete search history.

(56) References Cited

U.S. PATENT DOCUMENTS 4,925,121 A * 5/1990 Tapscott et al. ..... 242/563.2
6,126,343 A * 10/2000 Sugiyama et al. ..... 400/613

FOREIGN PATENT DOCUMENTS

JP 06-234448 * 8/1994
JP 2665499 B2 6/1997
JP 2002-2035 A 1/2002

OTHER PUBLICATIONS

Computer-generated translation of JP 2002-002035, published on Jan. 2002.*
Computer-generation translation of JP 06-234448, published on Aug. 1994.*

* cited by examiner

*Primary Examiner*—Huan H Tran
(74) *Attorney, Agent, or Firm*—Fitzpatrick, Cella, Harper & Scinto

(57) ABSTRACT

This invention is directed to a printing apparatus and printing medium roll-up state discrimination method of printing using a rolled printing medium while reliably rolling up the printing medium after printing and accurately detecting a roll-up error. This printing apparatus prints on a rolled printing medium, rolls it up in accordance with the discharge operation of the printing medium after printing, and optically detects the roll-up state of the printing medium upon roll-up. The printing apparatus discriminates an abnormality in the roll-up state of the printing medium on the basis of the detection result.

14 Claims, 13 Drawing Sheets

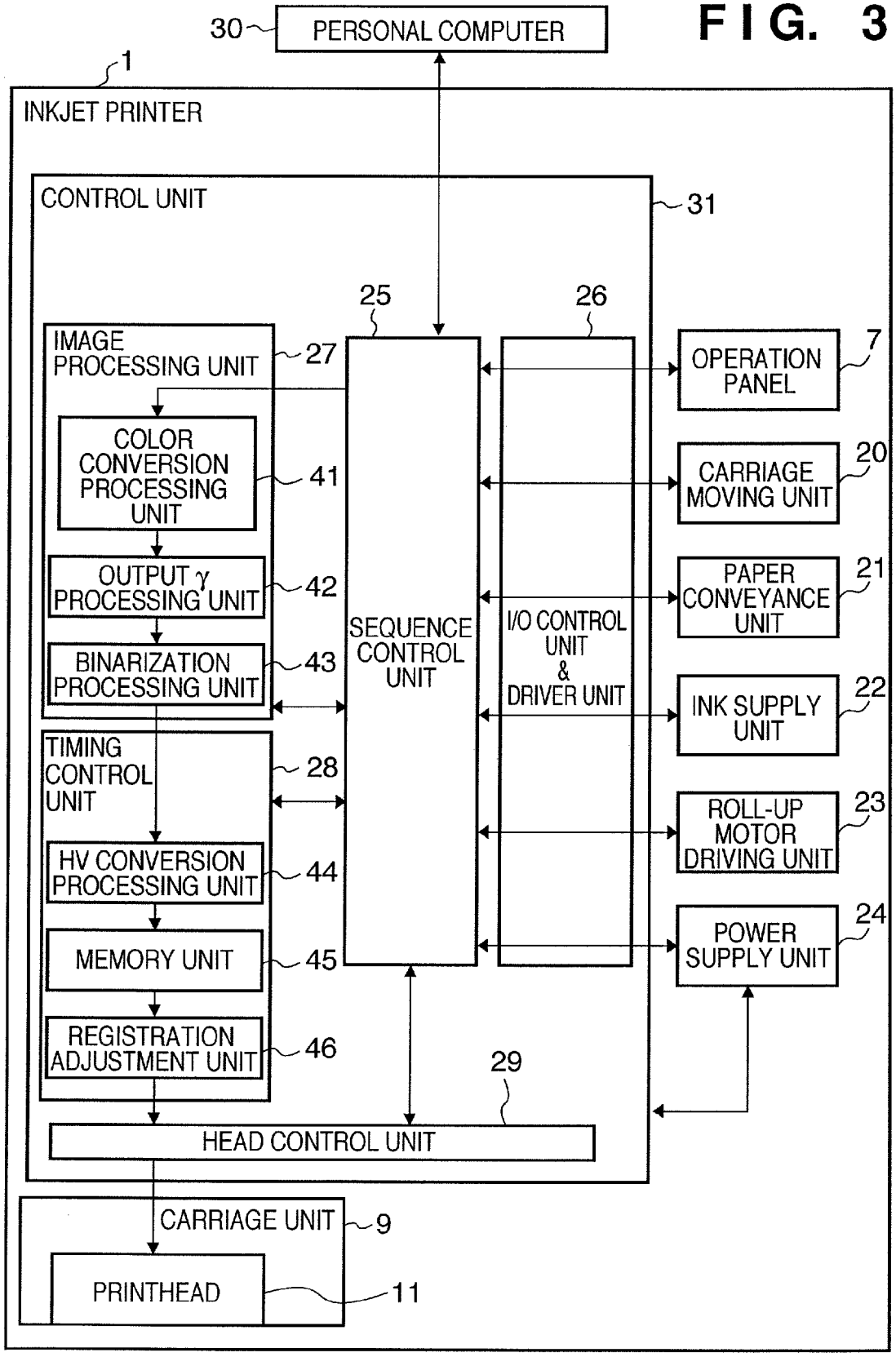
FIG. 3
30
PERSONAL COMPUTER
1
INKJET PRINTER
CONTROL UNIT
31
25
26
IMAGE PROCESSING UNIT
27
COLOR CONVERSION PROCESSING UNIT
41
OUTPUT γ PROCESSING UNIT
42
BINARIZATION PROCESSING UNIT
43
TIMING CONTROL UNIT
28
HV CONVERSION PROCESSING UNIT
44
MEMORY UNIT
45
REGISTRATION ADJUSTMENT UNIT
46
SEQUENCE CONTROL UNIT
I/O CONTROL UNIT & DRIVER UNIT
OPERATION PANEL
7
CARRIAGE MOVING UNIT
20
PAPER CONVEYANCE UNIT
21
INK SUPPLY UNIT
22
ROLL-UP MOTOR DRIVING UNIT
23
POWER SUPPLY UNIT
24
29
HEAD CONTROL UNIT
CARRIAGE UNIT
9
PRINTHEAD
11

FIG. 6

| PRINTING PAPER WIDTH | PRINTING SPEED | EXPECTED ON-DUTY |
|---|---|---|
| 36 INCHES | FAST | OD1 |
| 36 INCHES | NORMAL | OD2 |
| 36 INCHES | SLOW | OD3 |
| 44 INCHES | FAST | OD4 |
| 44 INCHES | NORMAL | OD5 |
| 44 INCHES | SLOW | OD6 |

PRINTING APPARATUS AND PRINTING MEDIUM ROLL-UP STATE DISCRIMINATION METHOD

BACKGROUND OF THE INVENTION

1. Field of the Invention

The present invention relates to a printing apparatus and printing medium roll-up state discrimination method. Particularly, the present invention relates to a printing apparatus which prints on a rolled printing medium with an inkjet printhead, and a printing medium roll-up state discrimination method.

2. Description of the Related Art

A conventional inkjet printing apparatus has a printhead on which a plurality of ink discharge nozzles (to be referred to as nozzles hereinafter) are arrayed in the printing medium conveyance direction (subscanning direction). A carriage which supports the printhead reciprocates in the moving direction (main scanning direction). At the same time, the conveyance roller repetitively conveys the printing medium in the subscanning direction, thereby printing on the entire printing medium.

Some printing apparatuses of this type can print on roll paper in addition to regular-size sheets such as A4 and A3 sheets. The roll paper is prepared by rolling printing paper elongated in the longitudinal direction (conveyance direction when the paper is set in the printing apparatus).

Methods of handling roll paper printed by a printing apparatus of a type which prints on roll paper are classified into two methods: One is to cut a printed part and discharge it into a basket after one printing job, and the other is to roll up printed roll paper around a dedicated spool and store it. According to the latter method, roll paper must be rolled up stably while controlling its roll-up state, and if an error occurs in the roll-up operation, the error must be detected reliably.

For example, Japanese Patent Laid-open No. 2002-002035 proposes a method of implementing stable roll-up. This method assumes a configuration in which roll paper discharged along with the progress of printing rotates while pressing a roller connected to an encoder scale in the printing apparatus. In this printing apparatus, a photo-interrupter detects the rotation of the encoder scale which rotates together with the discharged roll paper, thereby detecting the paper feed state. In accordance with the detected state, driving of the motor of the roll-up unit is controlled.

As a similar technology, for example, Japanese Patent No. 2,665,499 proposes a conveyance control method aiming at stable feed of a roll film in an exposure apparatus. According to this method, a roll film is slack before and after the exposure point in the exposure apparatus. Different sensors detect slack states before and after the exposure point, and different motors control feed of the roll film before and after the exposure point in accordance with outputs from the sensors, preventing an excessive load on the film.

However, if the roll-up unit cannot accurately roll up roll paper, the technique disclosed in Japanese Patent Laid-open No. 2002-002035 cannot discriminate this state as an error. Roll paper is pulled toward the roll-up side by setting the rotational speed of the motor on the roll-up side faster than that on the printing side. Thus, even if roll paper suffers strong pull, this cannot be detected.

The technique disclosed in Japanese Patent Laid-open No. 2002-002035 is effective under operating conditions free from any actual damage, for example, in a case where roll paper is small in size and its printed surface does not get dirty even upon contact with a roller or the like immediately after printing, just like roll paper set in an automatic teller machine (to be referred to as an ATM hereinafter) at a bank. However, this technique cannot be applied to a case where a printed image may be negatively affected if another member directly contacts the printed surface immediately after printing, like an inkjet printing apparatus.

The technique in Japanese Patent No. 2,665,499 discloses a method of controlling the slack amount of a roll film within a predetermined range. However, this patent does not describe error detection when, for example, a film is caught by the slack generating portion, and error removal processing upon generation of an error. A guide is arranged at the slack generating portion for the purpose of stable detection by the sensor. In an inkjet printing apparatus, however, it is impossible for the above-described reason to move printing paper immediately after printing along the guide.

Hence, demand has arisen for a method other than the conventional arts in order to reliably detect a roll-up error of a printing medium after printing regardless of its size or type and stably keep rolling up the printing medium in an inkjet printing apparatus using roll paper as a printing medium.

SUMMARY OF THE INVENTION

Accordingly, the present invention is conceived as a response to the above-described disadvantages of the conventional arts.

For example, a printing apparatus and printing medium roll-up state discrimination method according to this invention are capable of printing on a rolled printing medium while reliably rolling up the printing medium after printing and accurately detecting a roll-up error.

According to one aspect of the present invention, preferably, there is provided a printing apparatus which prints on a rolled printing medium, comprising: printing means for printing on the printing medium; roll-up means for rolling up the printing medium in accordance with a discharge operation of the printing medium printed by the printing means; detection means for detecting a roll-up state of the printing medium by the roll-up means without being in contact with the printing medium; and discrimination means for discriminating an abnormality of the roll-up state of the printing medium on the basis of a detection result by the detection means.

According to another aspect of the present invention, preferably, there is provided a printing medium roll-up state discrimination method of detecting a roll-up state of a printing medium printed by a printing apparatus which prints on a rolled printing medium, comprising: a printing step of printing on the printing medium; a roll-up step of rolling up the printing medium in accordance with a discharge operation of the printing medium printed in the printing step; a detection step of detecting the roll-up state of the printing medium in the roll-up step without being in contact with the printing medium; and a discrimination step of discriminating an abnormality of the roll-up state of the printing medium on the basis of a detection result in the detection step.

According to still another aspect of the present invention, preferably, there is provided a printing apparatus which prints on a rolled printing medium, comprising: printing means for printing on the printing medium; roll-up means for rolling up the printing medium which is printed and discharged; detection means for detecting a roll-up state of the discharged printing medium without being in contact with the printed surface of the printing medium; and control means for controlling the operation of the roll-up state of the printing medium on the basis of a detection result by the detection means.

According to still another aspect of the present invention, preferably, there is provided a roll-up apparatus which rolls up a rolled printing medium, comprising: roll-up means for rolling up the printing medium which is discharged from a printing apparatus; detection means for detecting a roll-up state of the discharged printing medium without being in contact with the printing medium; and control means for controlling the operation of the roll-up state of the printing medium on the basis of a detection result by the detection means.

The invention is particularly advantageous since a roll-up error can be detected when rolling up a rolled printing medium after printing. The invention is also advantageous since a non-contact sensor detects the roll-up state of a printing medium and does not directly contact the printed surface of the printing medium immediately after printing, thus preventing degradation of the printing quality.

Further features of the present invention will become apparent from the following description of exemplary embodiments (with reference to the attached drawings).

BRIEF DESCRIPTION OF THE DRAWINGS

FIG. 3 is a block diagram showing the control arrangement of the inkjet printing apparatus shown in FIG. 1;

FIG. 6 is a table showing an example of an expected ON-duty table according to the first embodiment;

DESCRIPTION OF THE EMBODIMENTS

Preferred embodiments of the present invention will now be described in detail in accordance with the accompanying drawings.

In this specification, the terms "print" and "printing" not only include formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

The whole structure of an inkjet printing apparatus to which the present invention is applied will be described.

Figure 1:
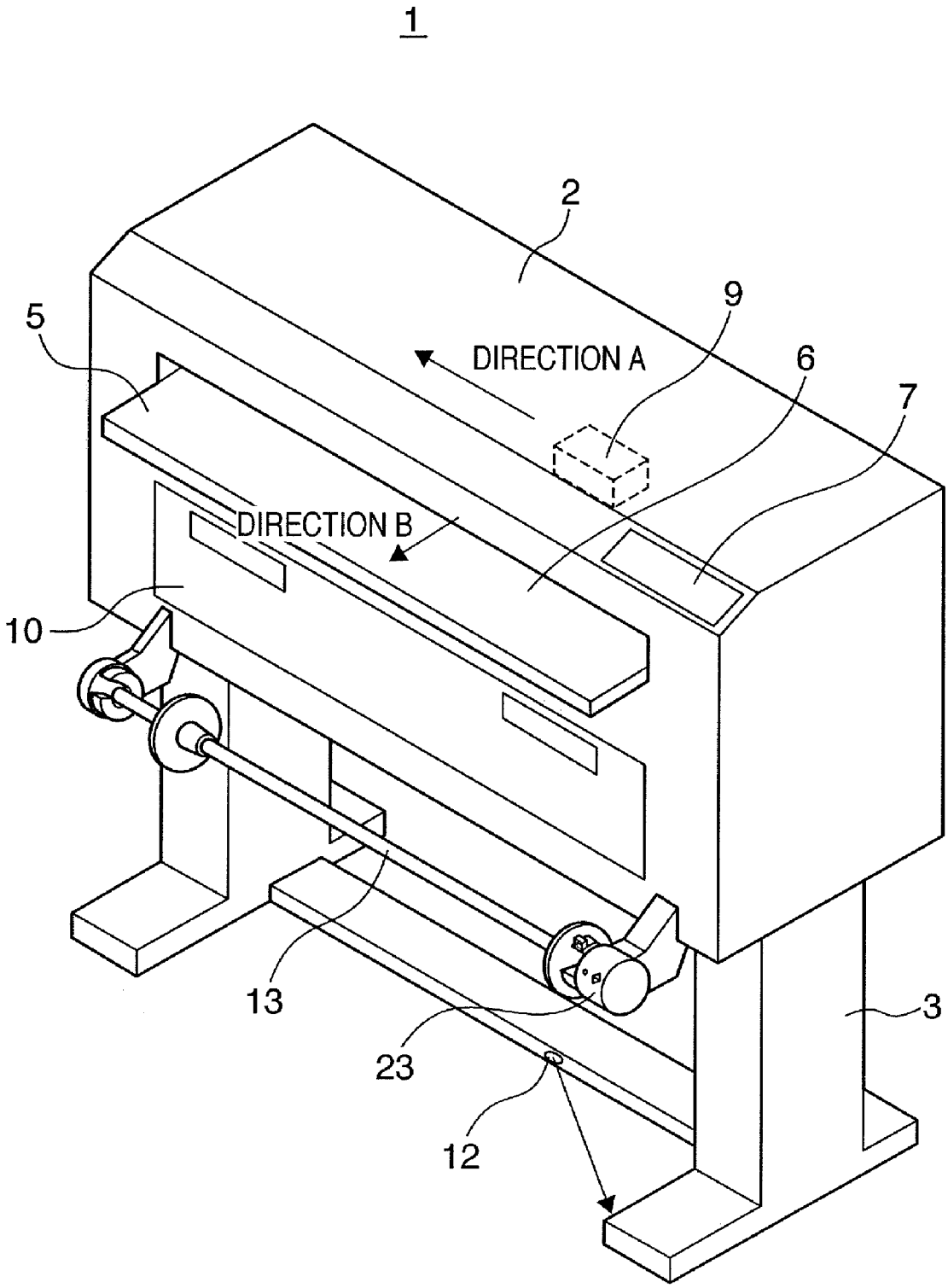
FIG. 1 is a perspective view showing the outer appearance of an inkjet printing apparatus as a typical embodiment of the present invention.
Figure 2:
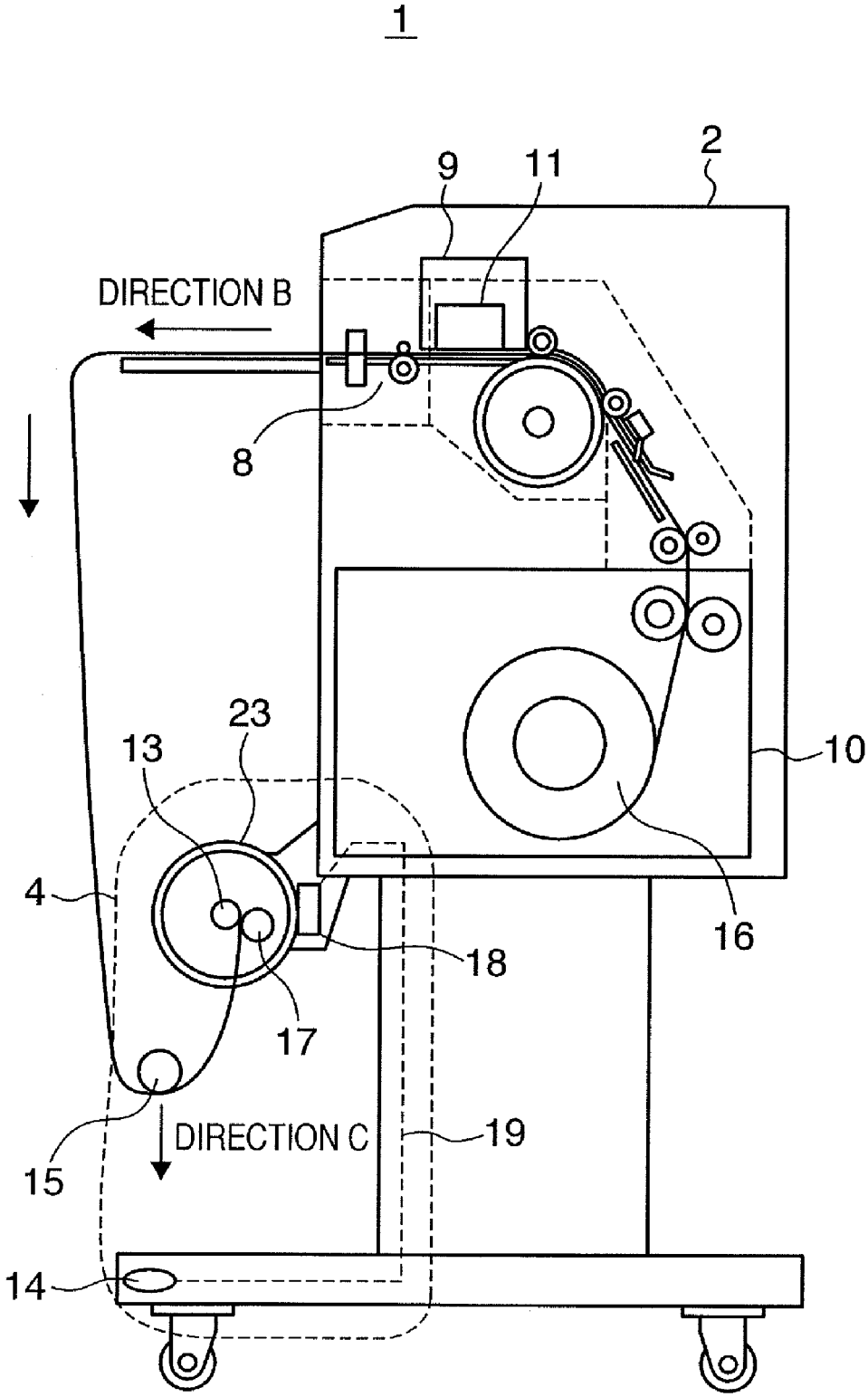
FIG. 2 is a side sectional view showing the internal structure of the inkjet printing apparatus shown in FIG. 1.

FIG. 1 is a schematic perspective view showing the outer appearance of an inkjet printing apparatus using a rolled printing medium as a typical embodiment of the present invention. FIG. 2 is a side sectional view showing the schematic internal structure of the inkjet printing apparatus shown in FIG. 1.

In FIGS. 1 and 2, an inkjet printing apparatus (to be referred to as a printing apparatus hereinafter) 1 comprises an apparatus main body 2, a stand 3 which supports the apparatus main body 2, and a roll-up device 4 which rolls up a printing medium such as discharged printing paper. The roll-up device 4 comprises a plurality of units associated with roll-up of printing paper, such as a roll-up motor driving unit 23 and roll-up spool 13. Details of the roll-up device 4 will be described later.

A discharge port 6 for printing media is formed in the front surface of the apparatus main body 2. A printing medium after printing is discharged down from a discharge table 5 extending from the discharge port 6. A roll paper cassette 10 is arranged below the discharge table 5, and stores roll paper 16 prepared by rolling up a printing medium such as printing paper. The roll paper 16 is supplied from the roll paper cassette 10 into the apparatus main body 2. An operation panel 7 is arranged on the right side of the apparatus main body 2. An ink supply unit (not shown) including ink tanks is provided in the apparatus main body 2. An infrared LED 12 and a light-receiving sensor 14 using a photodiode or the like are arranged face-to-face in the stand 3 so that the light-receiving sensor 14 can receive light emitted from the infrared LED 12. In this manner, the infrared LED 12 and light-receiving sensor 14 form a photo-interrupter.

The printing apparatus 1 further comprises a conveyance roller 8 for conveying a printing medium such as printing paper in a direction indicated by arrow B (subscanning direction), and a conveyance roller driving means (not shown) including a motor, gear, and the like for driving the conveyance roller 8. Also, the printing apparatus 1 comprises: a carriage unit 9 guided and supported to reciprocate in the widthwise direction (direction indicated by arrow A: main scanning direction) of the printing medium; a carriage motor (not shown) for reciprocating the carriage unit 9 in the main scanning direction; and a belt moving means (not shown).

The roll-up motor driving unit 23 incorporates a roll-up motor 17 which serves as a driving source for rolling up the roll paper 16 and rotates the roll-up spool 13. A roll-up motor driving circuit 18 drives the roll-up motor 17. The infrared LED 12 and light-receiving sensor 14 receive power through a cable 19, and a sensor output signal from the light-receiving sensor 14 is transferred to the roll-up motor driving unit 23 through the cable 19.

The carriage unit 9 supports a printhead 11 for color printing on a printing medium. The printhead can use, e.g., four inks of Bk (Black), C (Cyan), M (Magenta), and Y (Yellow) corresponding to inks of different colors. In addition to these inks, the printhead can also use two ink colors such as light C (light Cyan) and light M (light Magenta).

As another configuration of the printhead 11, a plurality of separate printheads are also available. These printheads may correspond to inks of different colors such as Bk (Black), C (Cyan), M (Magenta), and Y (Yellow). It is also possible to further adopt two printheads corresponding to two inks of light C (light Cyan) and light M (light Magenta) in addition to the above-mentioned colors.

FIG. 3 is a block diagram showing the control arrangement of the printing apparatus shown in FIGS. 1 and 2.

In FIG. 3, a personal computer (PC or host computer) 30 supplies image data to be printed, commands, and the like. The PC 30 is simply a well-known one having a keyboard and display. The PC 30 implements an interface with a user by application software, the printer driver of a printing apparatus, and dedicated printer control software (e.g., RIP). The printing apparatus 1 receives image data, commands, parameters, an image processing LUT (Look Up Table), and the like from the PC 30. The printing apparatus 1 prints an image by processing the received image data using the commands, parameters, and image processing LUT.

The printing apparatus 1 comprises a control unit 31 which controls the overall apparatus, the carriage unit 9 which supports the printhead 11, and a carriage moving unit 20 which reciprocates the carriage unit 9 in the main scanning direction. The printing apparatus 1 further comprises a paper conveyance unit 21 which conveys a printing medium such as roll printing paper in the subscanning direction, an ink supply unit 22 which supplies ink to the printhead 11, and the roll-up motor driving unit 23 which drives the roll-up motor. A power supply unit 24 supplies power to the printhead 11, control unit 31, and other respective units.

The operation panel 7 is provided with a key switch (not shown) and LCD (not shown).

The printing apparatus 1 also comprises a recovery unit (not shown) which recovers the printhead 11 to a good state by performing cleaning, ink suction, and the like for the ink discharge surface of the printhead 11. However, the recovery unit is not directly relevant to a description of the present invention, and a description of the recovery unit will not be repeated.

The carriage unit 9 has a removable mechanism capable of removing the printhead 11. Further, the carriage unit 9 has an electric contact, joints such as a tube for supplying ink, a member which supports and fixes the printhead 11, and a connecting portion with the carriage moving unit 20 (none of them are shown). The carriage unit 9 is supported by the rail (not shown) of the carriage moving unit 20, and connected to a carriage motor (not shown) by a timing belt (not shown) or the like. The carriage unit 9 reciprocates in the main scanning direction by rotation of the motor. The carriage unit 9 has an encoder sensor (not shown), and the carriage moving unit 20 has a linear scale (not shown) for the encoder in the main scanning direction. With this configuration, when the carriage unit 9 moves in the main scanning direction, the position of the mounted printhead 11 is detected to control its moving speed.

The paper conveyance unit 21 comprises a conveyance motor (not shown) used for driving the conveyance roller 8 to move a printing medium in the subscanning direction, and a rotary encoder (not shown) used for controlling the conveyance amount of a printing medium.

The ink supply unit 22 comprises a mechanism of supplying ink by connecting an ink tank unit (not shown) to the printhead 11 by an ink tube (not shown). A valve mechanism (not shown) is inserted in the ink tube. For example, upon replacing the printhead 11 or ink tank, the valve is closed to prevent ink leakage from the ink tube or printhead 11. A motor (not shown) is used as a driving source for driving the valve mechanism, and a photo-interrupter type position sensor (not shown) is used to detect the opening/closing state of the valve.

The power supply unit 24 is turned on/off with an AC switch (not shown) or a softswitch (not shown) on the operation panel 7. The power supply unit 24 supplies 3.3- or 5-V power as logic power to the control unit 31, and 24-V power to the actuator (e.g., motor) of each unit via an I/O control unit & driver unit 26 in the control unit 31. As head power to the printhead 11, the power supply unit 24 supplies a predetermined voltage set via a head power control unit (not shown) in the control unit 31.

The roll-up motor driving unit 23 comprises the roll-up motor 17 and roll-up motor driving circuit 18. The roll-up motor driving unit 23 incorporates an electric circuit (not shown) which processes a signal from the light-receiving sensor 14.

The control unit 31 functionally comprises an I/F control unit (not shown), a sequence control unit 25, an image processing unit 27, a timing control unit 28, a head control unit 29, the I/O control unit & driver unit 26, and the like. The I/F control unit serves as an interface with the personal computer 30, the sequence control unit 25 manages the overall operation, and the image processing unit 27 converts image data into print data. The timing control unit 28 adjusts the timing of print data in synchronism with the operation of the printing apparatus 1. The head control unit 29 controls the driving data, driving pulse, and driving voltage of the printhead 11, and the like. The I/O control unit & driver unit 26 serves as an interface with the sensor and actuator (e.g., motor) of units in the apparatus, and performs operation control and driving control.

The control unit 31 is physically an electric circuit board, and comprises the units 25 to 29. The sequence control unit 25 includes a CPU (not shown) such as a microprocessor, a ROM (not shown) which stores control programs and various data, a RAM (not shown) which is used as a work area for the CPU and temporarily stores various data, and an interface (I/F) with the PC 30. The image processing unit 27, timing control unit 28, and head control unit 29 are mainly formed from ASICs (not shown) and memories (not shown). The I/O control unit & driver unit 26 is comprised of an electric circuit including a general-purpose LSI and a transistor.

The image processing unit 27 includes a color conversion processing unit 41 which converts RGB image data from the PC 30 into color image data of ink colors (e.g., Bk, C, M, Y, LC, and LM) on the basis of an image processing LUT. The image processing unit 27 further includes an output 7 processing unit 42 which converts the color image data from the color conversion processing unit 41 on the basis of the output γ characteristic of the printing apparatus, and a binarization processing unit 43 which converts the color image data (n-ary data) from the output γ processing unit 42 into binary color print data.

The timing control unit 28 includes an HV conversion processing unit 44 which converts the order (raster order) of binary color print data output from the image processing unit 27 into the arrayed order (column order) of nozzles of the printhead 11. The timing control unit 28 also includes a memory unit 45 which stores HV-converted print data, and a registration adjustment unit 46. The registration adjustment unit 46 controls the read timing from the memory unit 45 for each print data of each ink in accordance with the position and moving direction of the printhead 11 and the like, and adjusts the printing position of each ink so as to prevent deviation of the printing position.

The head control unit 29 generates a signal in a data format supported by the printhead 11 on the basis of print data from the timing control unit 28, generates a driving signal under the control of the sequence control unit 25, and transfers these signals to the printhead 11. The printhead 11 is driven by the signals from the head control unit 29 to discharge ink and form an image on a printing medium.

The I/O control unit & driver unit 26 is driven by a signal timing-controlled by the sequence control unit 25, and drives and controls each connected unit.

When the printing apparatus 1 with the above arrangement is to print on a printing medium such as roll paper, the conveyance roller 8 conveys the printing medium to a predetermined printing start position. For the printing medium conveyed to the printing start position, the printing apparatus 1 repeats print scanning to discharge ink while scanning the printhead 11 in the main scanning direction, and a conveyance operation to convey the printing medium in the subscanning direction by the conveyance roller 8. As a result, the printing apparatus 1 prints on the entire printing medium.

More specifically, the carriage unit 9 drives the printhead 11 to print on a printing medium while moving in the direction indicated by arrow A in FIG. 1 by a carriage belt (not shown) and carriage motor (not shown). After the carriage unit 9 returns to the position before scanning, the conveyance roller 8 conveys the printing medium in the subscanning direction (direction indicated by arrow B in FIG. 1). Then, the carriage unit 9 is scanned again in the direction indicated by arrow A, printing an image, text, and the like on the printing medium.

There are two printing medium processing methods after the end of one image printing job on a rolled printing medium by repeating the above operation.

One method is to cut a printing medium after printing with a cutter mechanism (not shown) and discharge the cut printing medium into a discharge basket (not shown). The other is to continuously execute the next printing job without cutting a printed printing medium and roll up the printed printing medium using the roll-up device 4.

Upon using the roll-up device 4, the user adheres the end of roll paper to the roll-up spool 13 with a tape or the like before the start of printing. Further, the user places a spindle-shaped weight 15 at the slack of printing paper, as shown in FIG. 2. After the printing apparatus 1 starts printing upon reception of a printing instruction from the PC (personal computer) 30, the spindle-shaped weight 15 moves in direction C (down vertically) in FIG. 2 as roll paper is conveyed in the subscanning direction. When the spindle-shaped weight 15 moves down in direction C, the end of the spindle-shaped weight 15 interrupts light emitted from the photo-interrupter made up of the infrared LED 12 and light-receiving sensor 14. The respective members are arranged to achieve this operation.

Three embodiments of the roll-up device 4 in the above-described printing apparatus will be described, and the operation of the roll-up device 4 will be explained in detail.

First Embodiment

Figure 4:
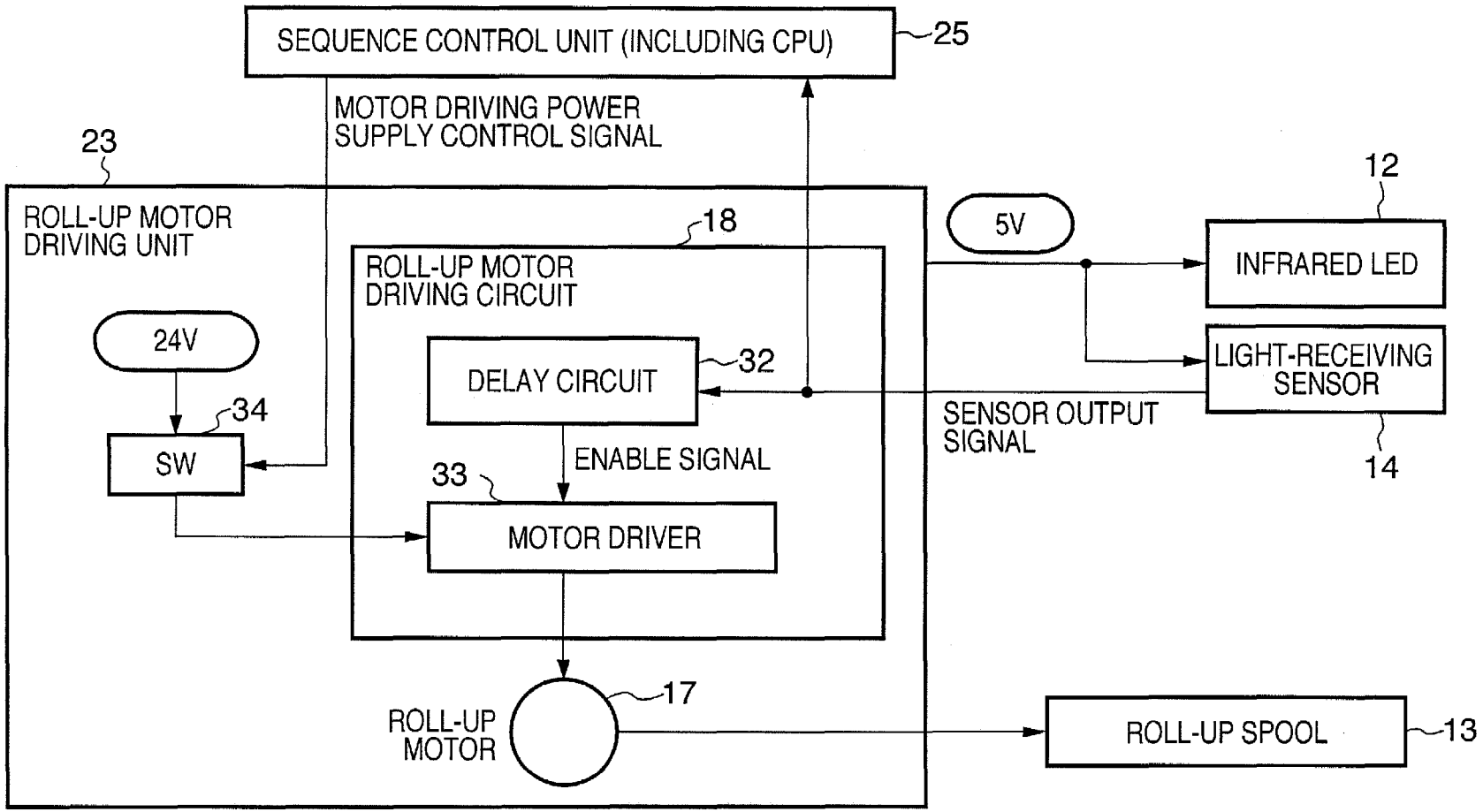
FIG. 4 is a block diagram showing the internal arrangement of a roll-up motor driving unit and also showing the relationship between the roll-up motor driving unit and a sequence control unit according to the first embodiment.

FIG. 4 is a block diagram showing the internal arrangement of a roll-up motor driving unit 23 according to the first embodiment. FIG. 4 shows the relationship between the roll-up motor driving unit 23 and a sequence control unit 25.

The roll-up motor driving unit 23 receives, via an I/O control unit & driver unit 26, power from a motor driving power supply (illustrated as 24 V in FIG. 4) for driving a roll-up motor 17, and power from a power supply (illustrated as 5 V in FIG. 4) for driving an infrared LED 12 and light-receiving sensor 14.

The motor driving power supply is turned on/off with a switch 34, and on/off-controlled by a motor driving power control signal from the sequence control unit 25. A sensor output signal from the light-receiving sensor 14 is input to a roll-up motor driver 33 as the enable signal of the motor driver 33 via a delay circuit 32. The circuit is configured such that the signal level when nothing interrupts light emitted from the above-mentioned photo-interrupter is defined as low level (L), and the signal level when the light emitted from the photo-interrupter is interrupted is defined as high level (H). When the signal changes to high level, the enable signal also changes to high level, and the motor driver 33 becomes active to rotate the roll-up motor 17. Then, a roll-up spool 13 rotates in a direction in which it rolls up roll paper, thereby rolling up the roll paper.

The delay circuit 32 is designed to decrease the time constant when the sensor output signal changes from low level to high level (at the start of driving the motor), and increase it when the sensor output signal changes from high level to low level (at the stop of driving the motor). This can be achieved by, for example, properly selecting the constant settings of a capacitor and resistor with reference to the input signal of a comparator. In this way, the minimum roll-up amount of roll paper once the light-receiving sensor 14 is turned on (changes to high level) is determined. The sensor output signal from the light-receiving sensor 14 is also input to the sequence control unit 25 so that the CPU can detect ON (H)/OFF (L) of the light-receiving sensor 14.

Figure 5:
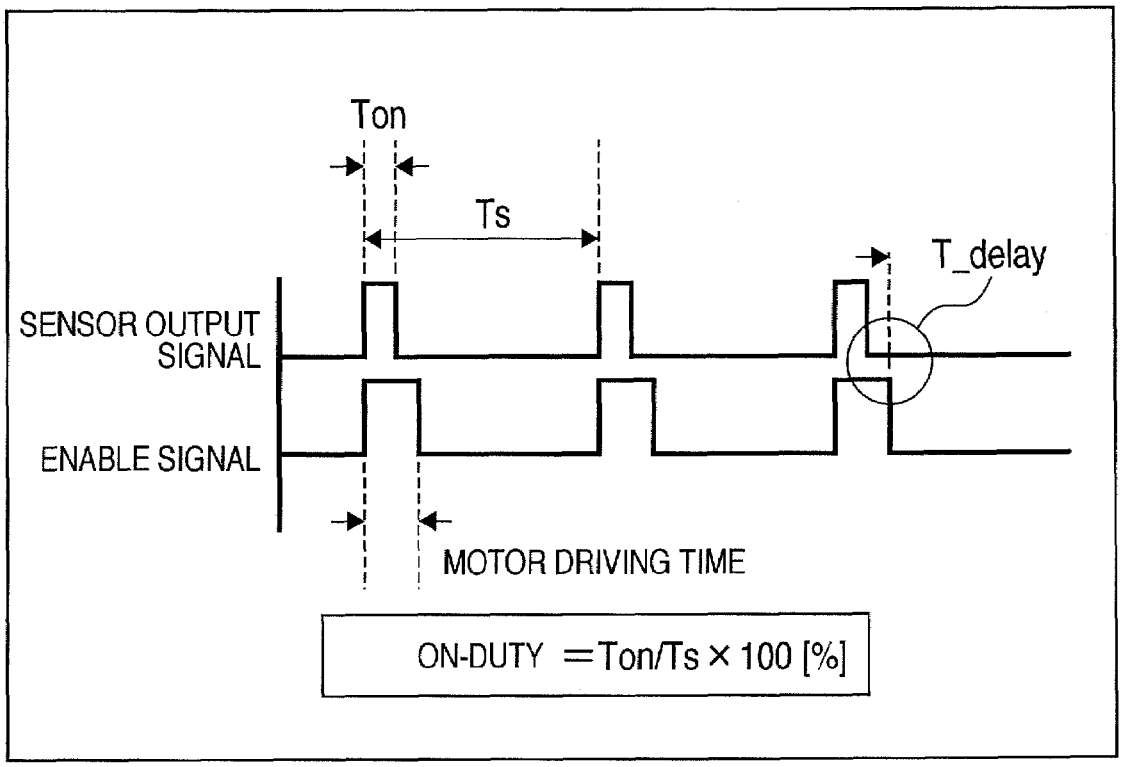
FIG. 5 is a timing chart showing the relationship between the sensor output signal and the enable signal according to the first embodiment.

FIG. 5 is a timing chart showing the relationship between the sensor output signal and the enable signal of the motor driver 33 when the roll-up operation is performed with the above-described arrangement.

During printing, roll paper is discharged in the direction B. When the printing medium which hangs down due to a spindle-shaped weight 15 interrupts the optical axis of the photo-interrupter made up of the infrared LED 12 and light-receiving sensor 14, the sensor output signal changes to high level. The enable signal also changes to high level, and the roll-up motor 17 rotates. As the roll-up motor 17 rotates, the spool 13 rolls up the roll paper, and the spindle-shaped weight 15 moves up vertically in opposition to the direction C. When the spindle-shaped weight 15 gets out of the detection area of the photo-interrupter, the photo-interrupter is turned off, the sensor output signal changes to low level, the enable signal also changes to low level, and the roll-up motor 17 stops. Even during this period, printing continues, and the spindle-shaped weight 15 moves again in direction C along with the discharge. After a certain time $T_s$ has lapsed, the sensor output signal changes to high level again. By repeating this operation, the spindle-shaped weight 15 periodically turns on the light-receiving sensor 14. T_delay represents the delay time until the enable signal goes OFF after the light-receiving sensor 14 is turned off.

As a result, the sensor output signal and the enable signal synchronized with it repetitively go ON and OFF, as shown in FIG. 5.

A method of discriminating an abnormality in the roll-up state in the roll-up mechanism having the above arrangement will be explained.

The conveyance amount of roll paper fed by the conveyance roller 8 within a predetermined time depends on the difference in printing conditions, and is determined by the printing width and speed. The roll-up amount of roll paper when the light-receiving sensor 14 is turned on once is designed by the speed of the roll-up motor 17, the diameter of the roll-up spool 13, the layout of respective members, and the delay circuit 32. Hence, the ON-duty of the sensor output signal when accurately rolling up roll paper without any wave or slip can be calculated. The calculated ON-duty is stored as an expected ON-duty in a non-volatile memory such as a ROM in the sequence control unit 25 in combination with printing conditions. Assuming that a printing medium is being discharged by a normal printing operation, the ratio of the ON time ($T_{on}$) of the light-receiving sensor 14 to the ON time period ($T_s$) of the light-receiving sensor 14 is defined as the ON-duty ($=T_{on}/T_s \times 100$).

FIG. 6 is a table showing an example of the expected ON-duty stored in the ROM.

In the first embodiment, the expected ON-duty is stored in combination with the printing paper width and printing speed, as shown in FIG. 6.

Figure 7:
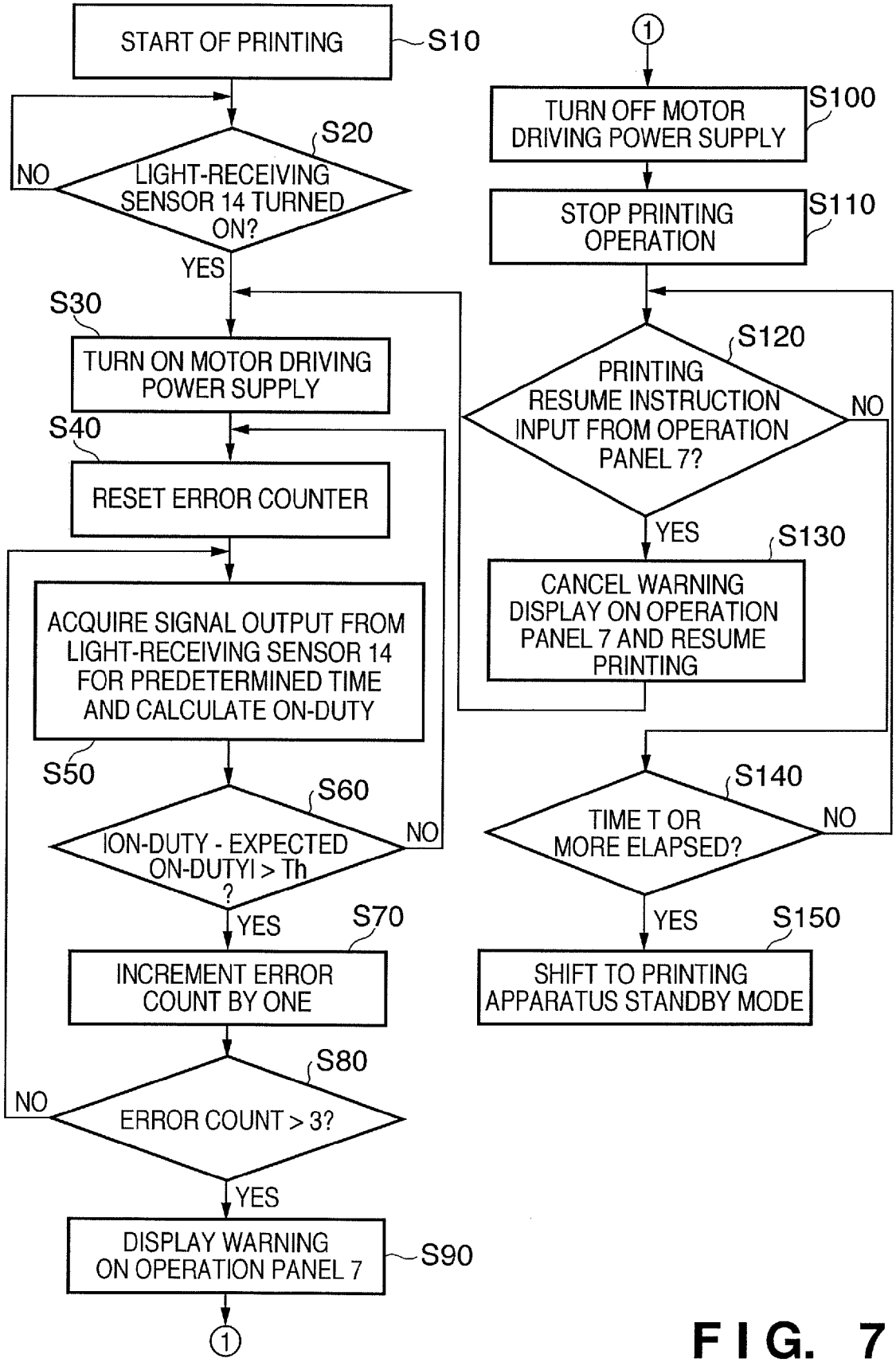
FIG. 7 is a flowchart showing a roll-up error detection method according to the first embodiment.

FIG. 7 is a flowchart showing a roll-up error detection method according to the first embodiment.

In step S10, printing on a printing medium using the roll-up device 4 starts. In step S20, the CPU in the sequence control unit 25 waits until the sensor output signal from the light-receiving sensor 14 goes ON for the first time after the start of printing.

After the sensor output signal goes ON, the roll-up motor driving power supply is turned on to start roll-up operation and error detection. In step S40, the error counter value ERR is reset. It is assumed that the data acquisition cycle of CPU is much shorter than the ON time period ($T_s$) of the light-receiving sensor 14.

In step S50 the CPU calculates the ON-duty every time the light-receiving sensor 14 is turned on, and calculates the difference ΔD between the calculated ON-duty and the expected ON-duty stored in the ROM. In step S60, the difference ΔD is compared with a predetermined threshold Th. If ΔD>Th holds, the process advances to step S70 to increment the error counter value ERR by one. In step S70, the error counter value ERR is compared with a predetermined value (three in this case). If ERR>3 holds, it is discriminated that the roll-up state of the printing medium is abnormal. The process advances to step S90 to generate a warning (e.g., to turn on a specific lamp, display a message, or ring a buzzer) via an operation panel 7. As another way of warning, a printer driver installed in a personal computer 30 may display a message on the display screen of the personal computer. To the contrary, if ERR≦3 holds, the process returns to step S50 to keep calculating the ON-duty.

If ΔD≦Th holds in step S60, the process returns to step S40 to reset the error counter and calculate the next ON-duty.

After generating a warning in step S90, the roll-up motor power supply is temporarily turned off in step S100, and the printing operation also stops in step S110. In step S120, the process waits for an instruction from the user. The warning contents displayed on the operation panel 7 contain a message prompting the user to solve the problem. In this case, work by the user is, for example, to adhere a printing medium to the roll-up spool 13 again or to remove an obstacle from the detection area of the photo-interrupter.

The following situations where the error counter value ERR exceeds "3", are conceivable in addition to a failure of a part.

<Case Where ON-Duty Keeps 100%>

1. Roll paper comes off the roll-up spool 13, and the spindle-shaped weight 15 or the roll paper itself interrupts light from the infrared LED 12.
2. Roll paper comes off the roll-up spool 13, and the roll-up spool 13 runs idle.
3. An obstacle exists in front of the infrared LED 12 or light-receiving sensor 14.

<Case Where ON-Duty Keeps 0%>

1. Roll paper comes off the roll-up spool 13, and falls to a position where the sensor cannot detect it.
2. Roll paper is rolled up obliquely, and no sensor can be turned on.

In any case, the CPU generates a warning. At the same time, the CPU temporarily turns off the roll-up motor power supply, stops printing, too, and waits for a user operation.

The user executes appropriate processing according to a message displayed on the operation panel 7, and instructs the printing apparatus 1 to resume printing from the operation panel 7. Upon reception of the printing resume instruction from the user, the process advances to step S130 to cancel the warning displayed on the operation panel 7, and the apparatus resumes printing. The process returns to step S30, and the CPU turns on the roll-up motor power supply, and restarts error detection from a time when the sensor output signal goes ON again. Error detection continues till the end of printing all data designated from the personal computer 30.

In contrast, if the process waits for an instruction from the user in step S120, the CPU measures the wait time $T_{idle}$, and compares it with a predetermined threshold T in step S140. If $T_{idle} \geqq T$ holds, it is presumed that the user is not near the printing apparatus because of, e.g. night operation, so the CPU determines that there is no printing resume instruction. The process advances to step S150, and the printing apparatus shifts to the standby mode.

Roll-up error detection when a print image contains a blank part will be described.

In general, if there is a blank area which need not be printed in an image data, roll paper is only conveyed in the direction B without printing with the printhead in order to shorten the total processing time. This operation will be called "blank skip".

Since the discharge speed is high during the blank skip, the light-receiving sensor 14 is turned on in a period shorter than the ON time period ($T_s$) during printing shown in FIG. 5. An expected ON-duty in this case is also calculable in advance, and another expected ON-duty is stored in the ROM in addition to the expected ON-duty during printing shown in FIG. 6. When the CPU determines in accordance with print data that the current printing operation is blank skip, it calculates the difference between the calculated ON-duty and an expected ON-duty for blank skip, and compares the difference ΔD with the threshold Th. Whether or not blank skip is in progress can be determined on the basis of actual output pulses from a rotary encoder attached to the conveyance roller 8 and the expected number of pulses during image printing, for example.

According to the above-described embodiment, whether or not roll paper is rolled up normally can be determined on the basis of the ON/OFF cycle of the sensor output signal obtained from the photo-interrupter sensor arranged in the hang-down space of roll paper.

If a roll-up abnormality occurs, the user is immediately notified of it, and can avoid any damage caused by falling of a printed material or entanglement in the roll-up device. Even if an error occurs while printing a plurality of images, the printing operation can resume after removing the cause of the error without completely stopping whole printing job.

The use of the optical sensor and spindle-shaped weight prevents degradation of the printing quality because sensor detection need not contact the printed surface of a printing medium immediately after printing.

Moreover, when the size of printing medium is large as in a large-sized printer and many types of printing media are available, a roll-up error can be reliably detected regardless of the size and type.

A printing medium after printing is rolled up in accordance with the discharge operation without forcibly deciding the slack of the printing medium. The printing medium does not receive any unnecessary force, and are prevented from damage on it.

In the first embodiment, the optical sensor including the infrared LED 12 and light-receiving sensor 14 is used to detect a discharged printing medium. However, an optical sensor including an ultraviolet LED or visible light LED other than the infrared LED is also available. Alternatively, a non-contact detectable ultrasonic sensor or proximity sensor other than the optical sensor may be used to detect a discharged printing medium. Further, the position of a discharged printing medium may be detected by sensing the medium with a CCD and processing the sensed image. In this fashion, a sensor other than the optical sensor is available as long as the sensor can detect the roll-up state of a printing medium without being in contact with the discharged printing medium.

Second Embodiment

Figure 8:
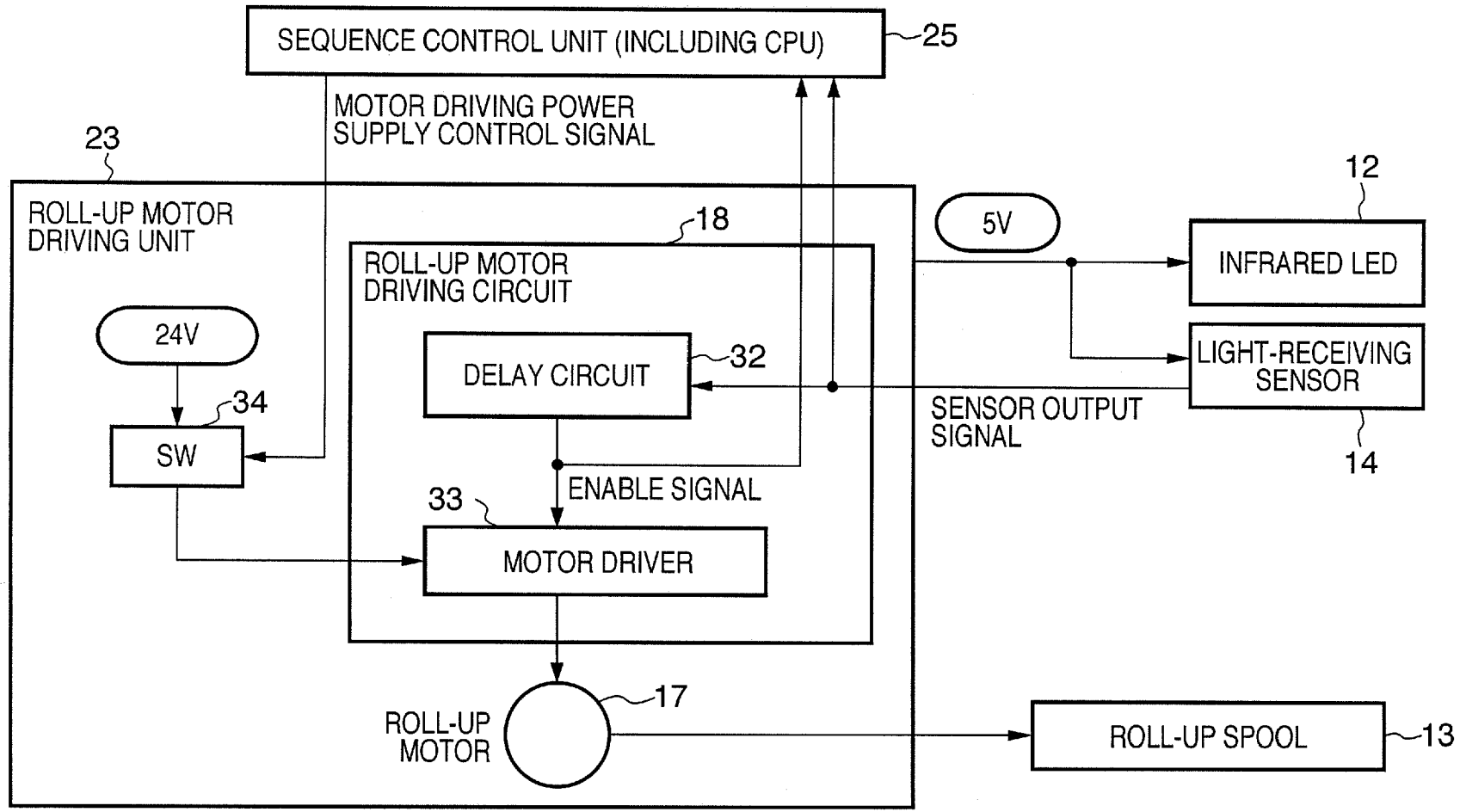
FIG. 8 is a block diagram showing the internal arrangement of a roll-up motor driving unit and also showing the relationship between the roll-up motor driving unit and a sequence control unit according to the second embodiment.

FIG. 8 is a block diagram showing the internal arrangement of a roll-up motor driving unit 23 according to the second embodiment. FIG. 8 shows the relationship between the roll-up motor driving unit 23 and a sequence control unit 25. The same reference numerals as those described in the first embodiment denote the same parts, and a detailed description thereof will not be repeated.

As shown in FIG. 8, the roll-up motor driving unit 23 outputs the enable signal of a motor driver 33 to the sequence control unit together with the sensor output signal of a light-receiving sensor 14. A delay circuit 32 is designed to set a delay time T_delay to be 1 second until the enable signal goes OFF after the light-receiving sensor 14 is turned off. Once the light-receiving sensor 14 is turned on, a roll-up motor 17 rotates for at least 1 second to perform the roll-up operation.

Figure 9:
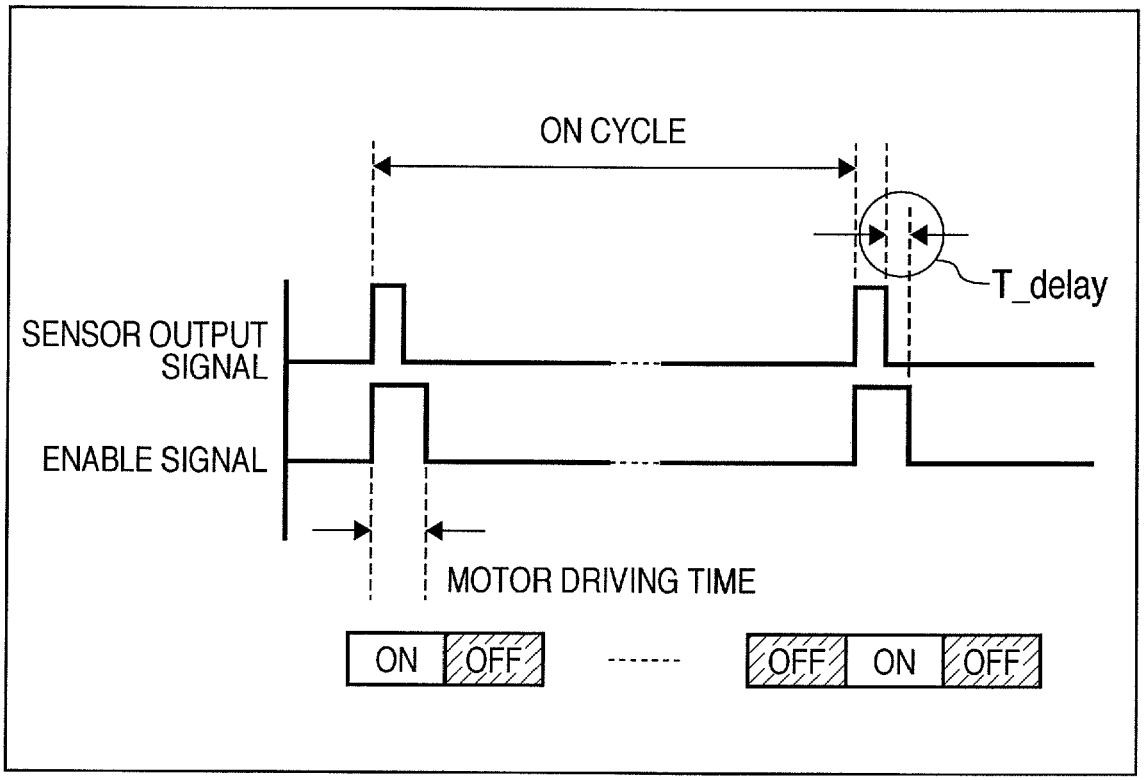
FIG. 9 is a timing chart showing the relationship between the sensor output signal and the enable signal according to the second embodiment.

FIG. 9 is a timing chart showing the relationship between the sensor output signal and the enable signal of the motor driver 33 when the roll-up operation is performed with the above-described arrangement.

The ON duration when the ON state of the enable signal continues is defined as addition of T_delay and a period from a time when a spindle-shaped weight 15 enters the detection area of a photo-interrupter made up of an infrared LED 12 and the light-receiving sensor 14 to a time when the spindle-shaped weight 15 comes out from it in the roll-up operation. The ON duration depends on the diameter of a roll-up spool 13, the positional relationship between the roll-up spool 13 and the light-receiving sensor 14, the rotational speed of the roll-up motor 17, and the amount of printing medium rolled up around the roll-up spool 13 regardless of the printing speed. The ON duration is longest when no printing medium is rolled up. In the second embodiment, the diameter and layout of the roll-up spool 13, and the motor speed are so decided as to set a maximum ON duration to be 3 seconds. To the contrary, the OFF duration when the OFF state of the enable signal continues depends on the discharge speed. The OFF duration is longest at the lowest printing speed. The second embodiment assumes that the maximum OFF duration is 30 seconds.

Figure 10:
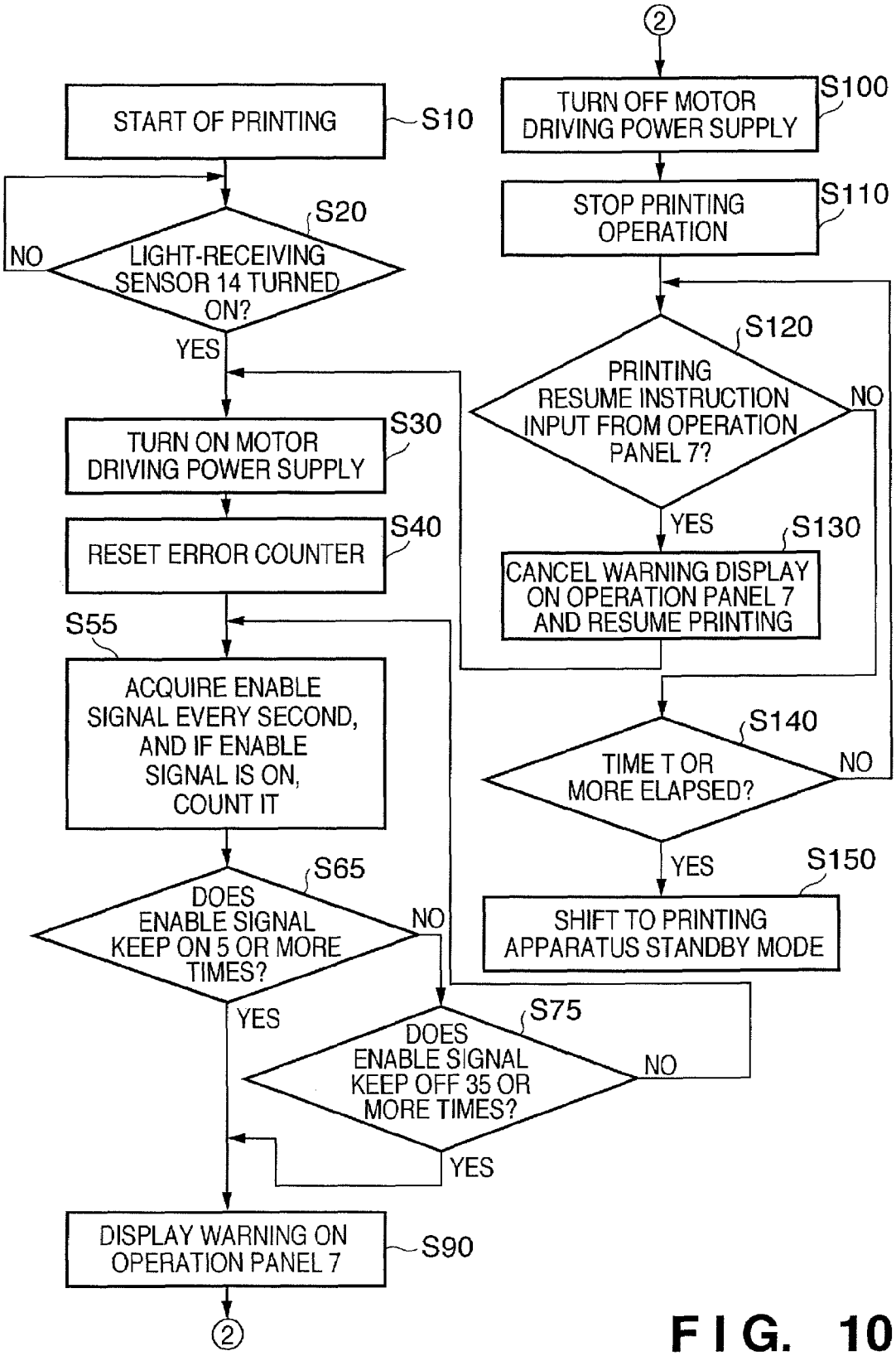
FIG. 10 is a flowchart showing a roll-up error detection method according to the second embodiment.

FIG. 10 is a flowchart showing a roll-up error detection method according to the second embodiment.

In FIG. 10, the same step reference numerals as those described in the first embodiment denote the same processing steps, and a description thereof will not be repeated.

Similar to the first embodiment, after printing on roll paper starts, the sequence control unit 25 turns on the roll-up motor driving power supply to start error detection after the sensor output signal from the light-receiving sensor 14 goes ON for the first time after the start of printing.

After the processes in steps S10 to S40, the CPU acquires an enable signal every second, and if the signal is ON, counts it in step S55.

The CPU determines that a roll-up error has occurred when the count of the enable signal meets any one of the following conditions: (1) the enable signal keeps ON five or more times, and (2) the enable signal keeps OFF 35 or more times.

In step S65, the CPU checks whether the enable signal keeps ON five or more times. If the CPU determines that the enable signal keeps ON five or more times (YES in step S65), it determines that a roll-up error has occurred, and the process advances to step S90; if NO in step S65, to step S75. In step S75, the CPU checks whether the enable signal keeps OFF 35 or more times. If the CPU determines that the enable signal keeps OFF 35 or more times (YES in step S75), it determines that a roll-up error has occurred, and the process advances to step S90; if NO in step S75, returns to step S55.

The processes in step S90 and subsequent steps are executed similarly to those described in the first embodiment. Blank skip is detected similarly to the first embodiment.

If blank skip occurs, the driving time of the roll-up motor 17 is longer than that in the normal operation, depends on the contents of an image, and is unpredictable. In practice, however, an upper limit is necessary for processing. For this reason, when blank skip occurs, condition (1) out of the two roll-up error determination conditions changes to "the enable signal keeps ON 20 or more times".

According to the above-described embodiment, whether or not roll paper is rolled up normally can be determined on the basis of the ON/OFF count of the sensor output signal obtained from the photo-interrupter sensor arranged in the hang-down space of roll paper.

Third Embodiment

Figure 11:
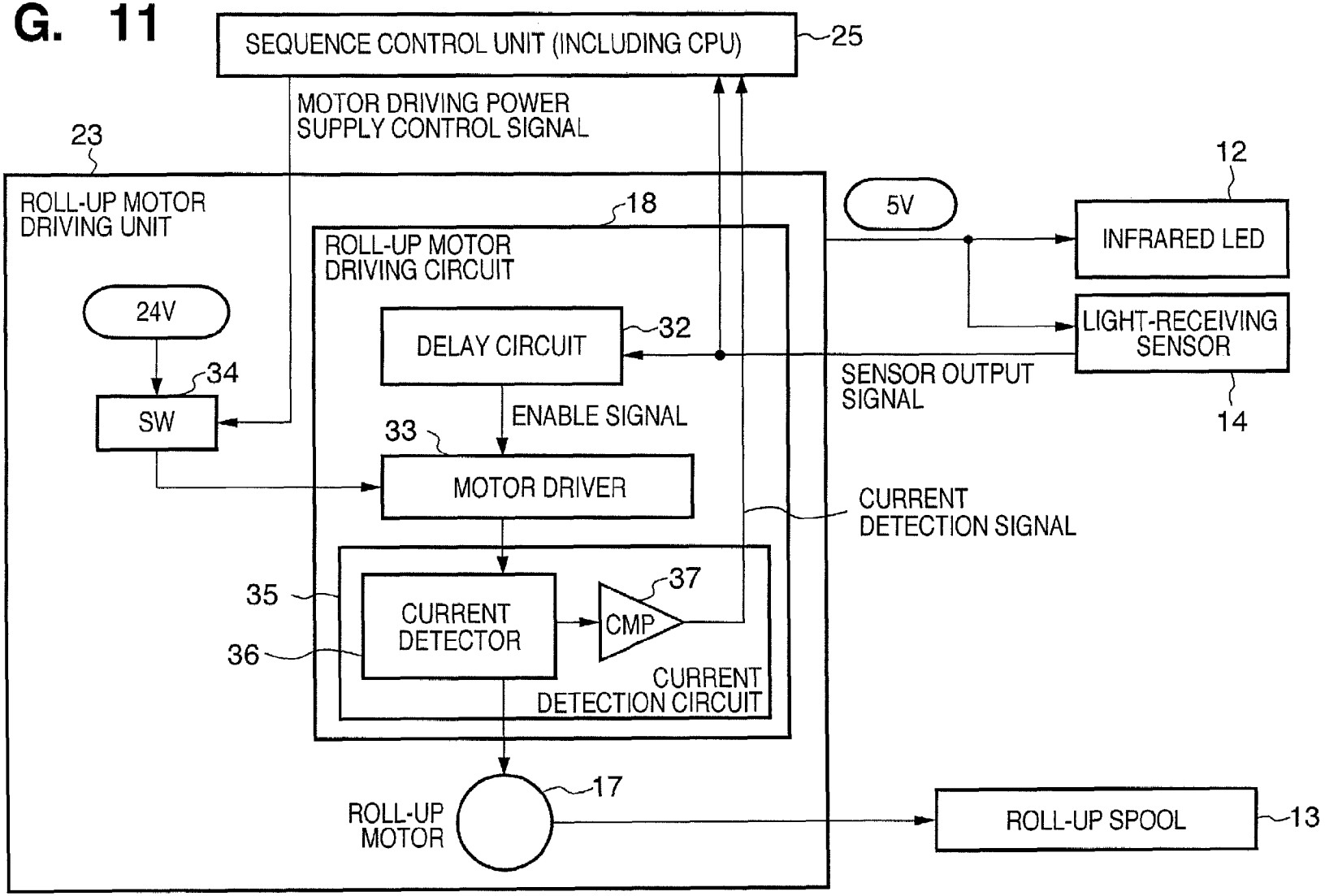
FIG. 11 is a block diagram showing the internal arrangement of a roll-up motor driving unit and also showing the relationship between the roll-up motor driving unit and a sequence control unit according to the third embodiment.

FIG. 11 is a block diagram showing the internal arrangement of a roll-up motor driving unit 23 according to the third embodiment. FIG. 11 shows the relationship between the roll-up motor driving unit 23 and a sequence control unit 25. The same reference numerals as those described in the first and second embodiments denote the same parts, and a detailed description thereof will not be repeated.

As shown in FIG. 11, a current detection circuit 35 which detects a current flowing through a roll-up motor 17 is interposed between a motor driver 33 and the roll-up motor 17. The current detection circuit 35 incorporates a current detector 36 and comparator 37. A current supplied to the roll-up motor 17 undergoes current-to-voltage conversion by the current detector 36 using a current detection resistor, and is input to the comparator 37.

The threshold voltage Th_On of the comparator 37 is set to a value at which the motor current is reliably detected as a high-level (H) current when roll paper is rolled up normally, and a low-level (L) current when no motor rotates. A signal output from the comparator 37 is input as a current detection signal to the sequence control unit 25.

Similar to the second embodiment, a delay circuit 32 is designed to set a delay time T_delay to be 1 second. The delay time T_delay is defined as a period from a time when a light-receiving sensor 14 is turned off to a time when the enable signal goes OFF. Once the light-receiving sensor 14 is turned on, the roll-up motor 17 rotates for at least 1 second to perform the roll-up operation. The threshold voltage Th_On is set to make the high-level period of the current detection signal much longer than that of the enable signal.

Figure 12:
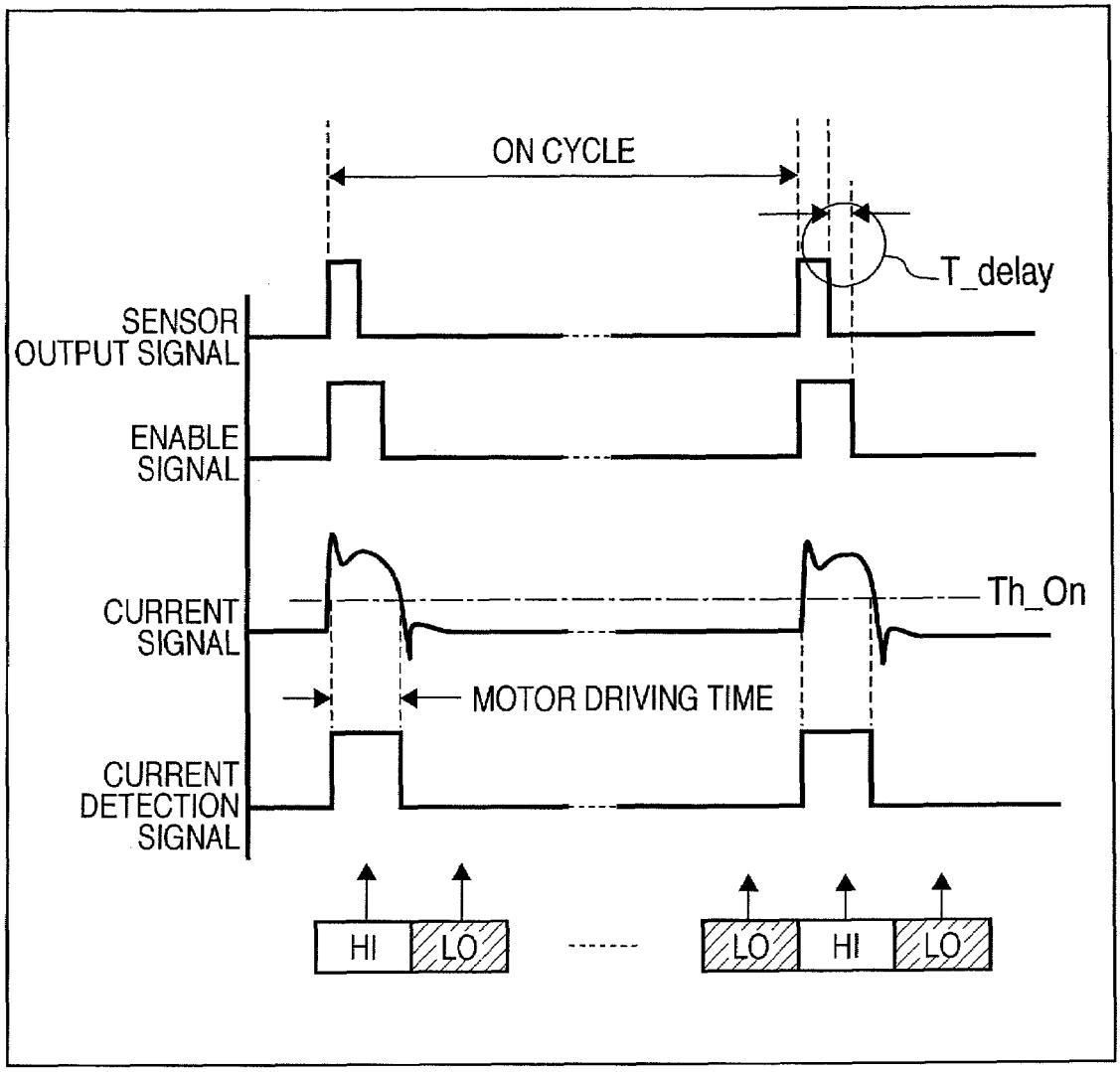
FIG. 12 is a timing chart showing the relationship between the sensor output signal and the enable signal according to the third embodiment.

FIG. 12 is a timing chart showing the relationship between the sensor output signal, the enable signal of the motor driver 33, and the current detection signal when the roll-up operation is performed with the above-described arrangement.

The ON duration when the ON state of the enable signal continues is defined as addition of T_delay and a period from a time when a spindle-shaped weight 15 enters the detection area of a photo-interrupter made up of an infrared LED 12 and the light-receiving sensor 14 to a time when the spindle-shaped weight 15 comes out from it in the roll-up operation. The ON duration depends on the diameter of a roll-up spool 13, the positional relationship between the roll-up spool 13 and the light-receiving sensor 14, the rotational speed of the roll-up motor 17, and the amount of printing medium rolled up around the roll-up spool 13 regardless of the printing speed. The ON duration is longest when no printing medium is rolled up. In the third embodiment, the diameter and layout of the roll-up spool 13, and the rotational speed of the motor are so designed as to set a maximum ON duration to be 3 seconds. The maximum high-level duration of the current detection signal is also designed 3 seconds, similar to the enable signal.

To the contrary, the OFF duration when the OFF state of the enable signal continues depends on the discharge speed. The OFF duration is longest at the lowest printing speed. The third embodiment assumes that the maximum OFF duration is 30 seconds, and also assumes that the maximum low-level duration of the current detection signal is 30 seconds.

Figure 13:
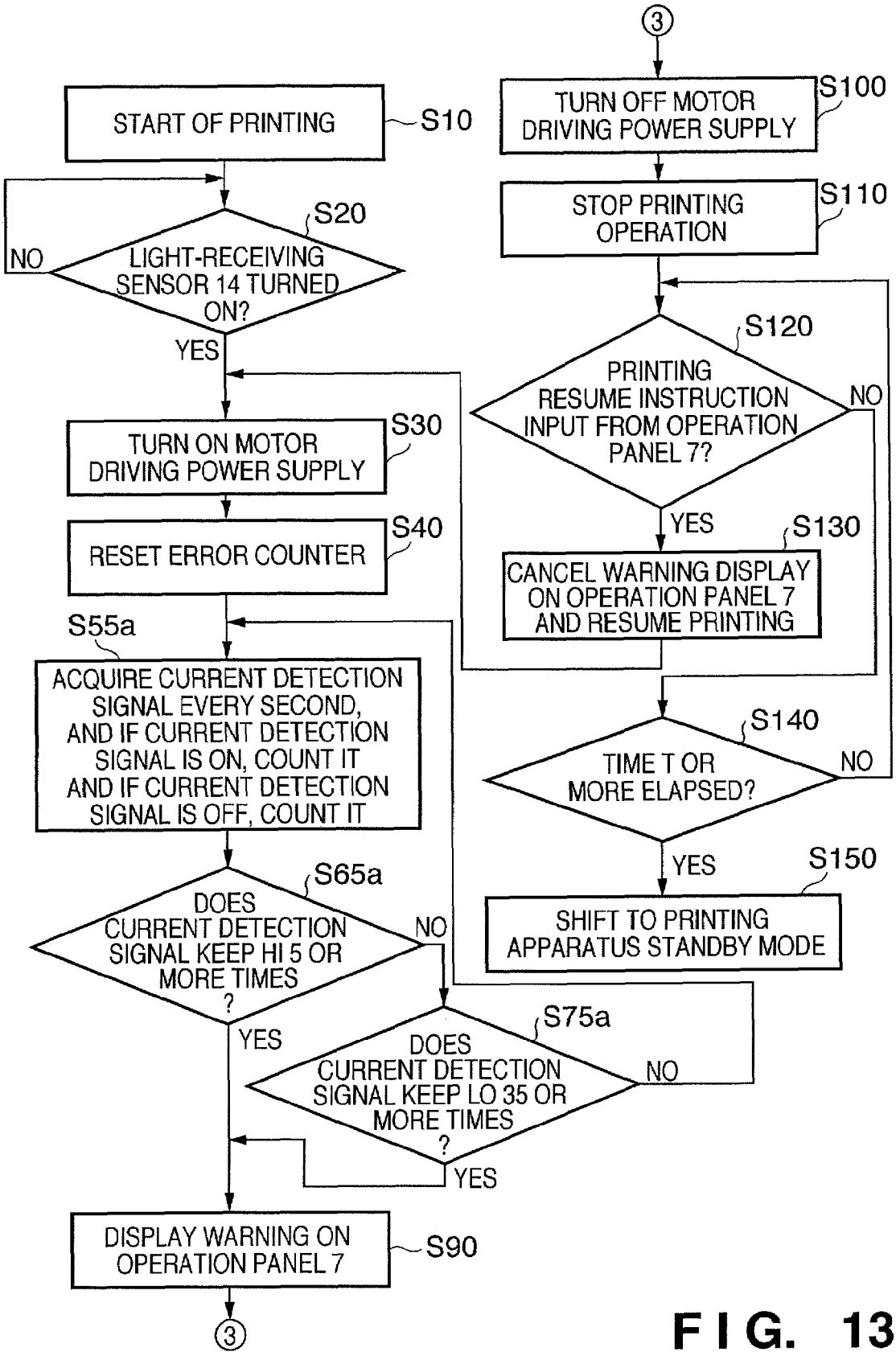
FIG. 13 is a flowchart showing a roll-up error detection method according to the third embodiment.

FIG. 13 is a flowchart showing a roll-up error detection method according to the third embodiment.

In FIG. 13, the same step reference numerals as those described in the first and second embodiments denote the same processing steps, and a description thereof will not be repeated.

Similar to the first and second embodiments, after printing on roll paper starts, the sequence control unit 25 turns on the roll-up motor driving power supply to start error detection after the sensor output signal from the light-receiving sensor 14 goes ON for the first time after the start of printing.

After the processes in steps S10 to S40, the CPU acquires a current detection signal every second, and if the signal is at high level, counts it in step S55*a*; if the signal is at low level, also counts it.

The CPU determines that a roll-up error has occurred when the count of the current detection signal meets any one of the following conditions: (1) the current detection signal keeps high level five or more times, and (2) the current detection signal keeps low level 35 or more times.

In step S65*a*, the CPU checks whether or not the current detection signal keeps high level five or more times. If the CPU determines that the current detection signal keeps high level five or more times (YES in step S65*a*), it determines that a roll-up error has occurred, and the process advances to step S90; if NO in step S65*a*, to step S75*a*. In step S75*a*, the CPU checks whether or not the current detection signal keeps low level 35 or more times. If the CPU determines that the current detection signal keeps low level 35 or more times (YES in step S75*a*), it determines that a roll-up error has occurred, and the process advances to step S90; if NO in step S75*a*, returns to step S55*a*.

The processes in step S90 and subsequent steps are executed similarly to those described in the first embodiment. Blank skip is detected similarly to the first embodiment.

If blank skip occurs, the driving time of the roll-up motor 17 is longer than that in the normal operation, depends on the contents of an image, and is unpredictable. In practice, however, an upper limit is necessary for processing. For this reason, when blank skip occurs, the roll-up error determination conditions (1) is changed to "the current detection signal keeps high level 20 or more times".

According to the above-described embodiment, whether or not roll paper is rolled up normally can be determined from transition of a current supplied to the roll-up motor on the basis of the sensor output signal obtained from the photo-interrupter sensor arranged in the hang-down space of roll paper.

Furthermore, the inkjet printing apparatus according to the present invention may be used as an image output apparatus for an information processing device such as a computer. The inkjet printing apparatus may take the form of a copying machine combined with a reader or the like, or a facsimile machine having a transmission/reception function.

The present invention may be applied to a system including a plurality of devices (e.g., a host computer, interface device, reader, and printer) or an apparatus (e.g., a copying machine or facsimile machine) formed by a single device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-169387, filed Jun. 19, 2006, which is hereby incorporated by reference herein in its entirety.

What is claimed is:

1. A printing apparatus which prints on a rolled printing medium, comprising:

printing means for printing on the printing medium;

roll-up means for rolling up the printing medium in accordance with a discharge operation of the printing medium printed by said printing means;

detection means for detecting a roll-up state of the printing medium by said roll-up means without being in contact with the printing medium; and discrimination means for discriminating an abnormality of the roll-up state of the printing medium on the basis of a detection result by said detection means.

2. The apparatus according to claim 1, wherein said printing means includes:

a cassette which stores the rolled printing medium;

a printhead which prints on the printing medium supplied from the cassette; and discharge means for discharging a printed part of the printing medium by conveying the printing medium printed by the printhead so as to hang down from the apparatus, said roll-up means includes:

a spool which is arranged below the discharge means and rolls up the discharged printing medium which hangs down;

a roll-up motor which rotates the spool; and a spindle-shaped weight which is interposed between the spool and the discharged printing medium which hangs down and, and weights the discharged printing medium vertically, said detection means detects that the discharged printing medium hangs down by a predetermined amount or more due to the spindle-shaped weight, and the spool is arranged above said detection means.

3. The apparatus according to claim 2, wherein said detection means includes:

a light-emitting element which emits light; and a light-receiving element which receives light emitted from the light-emitting element, and the light-emitting element and the light-receiving element are so arranged as to interrupt an optical axis between the light-emitting element and the light-receiving element by the printing medium which hangs down due to the spindle-shaped weight.

4. The apparatus according to claim 3, further comprising roll-up control means for, when the discharged printing medium hangs down and interrupts the optical axis, and said detection means detects presence of the printing medium, controlling to rotate the spool by driving the roll-up motor and roll up the printing medium which hangs down, and when the discharged printing medium is rolled up and does not interrupt the optical axis, and said detection means no longer detects the presence of the printing medium, controlling said roll-up means to stop driving the roll-up motor and stop rolling up the printing medium.

5. The apparatus according to claim 4, wherein said discrimination means includes:

comparison means for comparing, with a predetermined threshold, a ratio between a duration when the presence of the printing medium is detected and a period from a time when the presence of the printing medium is detected till a time when the presence of the printing medium is detected next; and determination means for determining, in accordance with a comparison result by the comparison means, whether or not an abnormality occurs in the roll-up state of the printing medium.

6. The apparatus according to claim 5, wherein the predetermined threshold is determined by at least any one of a printing speed of said printing means, a printing width of the rolled printing medium, a discharge speed of the printing medium, and a roll-up speed of the printing medium.

7. The apparatus according to claim 4, wherein said discrimination means includes determination means for detecting, in a predetermined cycle, an enable signal generated to drive the roll-up motor by said roll-up control means, and determining, on the basis of an ON/OFF state of the detected enable signal, whether or not an abnormality occurs in the roll-up state of the printing medium.

8. The apparatus according to claim 4, wherein said discrimination means includes determination means for detecting, in a predetermined cycle, a motor driving current supplied to the roll-up motor on the basis of an enable signal generated to drive the roll-up motor by said roll-up control means, and determining, on the basis of an ON/OFF state of the detected motor driving current, whether or not an abnormality occurs in the roll-up state of the printing medium.

9. The apparatus according to claim 5, wherein in a case where said discrimination means discriminates that an abnormality occurs in the roll-up state of the printing medium, said roll-up control means controls to stop roll-up by said roll-up means.

10. The apparatus according to claim 9, further comprising printing control means for controlling to stop a printing operation by said printing means along with the stop of roll-up by said roll-up means.

11. The apparatus according to claim 5, further comprising notification means for notifying a user of occurrence of an abnormality in a case where said discrimination means discriminates that the abnormality occurs in the roll-up state of the printing medium.

12. A printing medium roll-up state discrimination method of detecting a roll-up state of a printing medium printed by a printing apparatus which prints on a rolled printing medium, comprising:

a printing step of printing on the printing medium;

a roll-up step of rolling up the printing medium in accordance with a discharge operation of the printing medium printed in the printing step;

a detection step of detecting the roll-up state of the printing medium in the roll-up step without being in contact with the printing medium; and a discrimination step of discriminating an abnormality of the roll-up state of the printing medium on the basis of a detection result in the detection step.

13. A printing apparatus which prints on a rolled printing medium, comprising:

printing means for printing on the printing medium;

roll-up means for rolling up the printing medium which is printed and discharged;

detection means for detecting a roll-up state of the discharged printing medium without being in contact with the printed surface of the printing medium; and control means for controlling the operation of the roll-up state of the printing medium on the basis of a detection result by said detection means.

14. A roll-up apparatus which rolls up a rolled printing medium, comprising:

roll-up means for rolling up the printing medium which is discharged from a printing apparatus;

detection means for detecting a roll-up state of the discharged printing medium without being in contact with the printing medium; and control means for controlling the operation of the roll-up state of the printing medium on the basis of a detection result by said detection means.

* * * * *